US005083664A

United States Patent [19]

Feng

[11] Patent Number: 5,083,664

[45] Date of Patent: Jan. 28, 1992

[54] MULTI-STORIED TOOL BOX

[76] Inventor: Yee-Chang Feng, 2F, No. 166-5, Hsi Twen Rd., Sec. 3, Tai Chung City, Taiwan

[21] Appl. No.: 568,154

[22] Filed: Aug. 16, 1990

[51] Int. Cl.[5] ..... B65D 85/20

[52] U.S. Cl. ..... 206/372; 206/376; 206/378; 206/509; 206/514; 211/70.6; 220/23.83

[58] Field of Search ..... 206/372-379, 206/509, 514, 806; 211/70.6, 74, 126; 220/4.26, 4.27; 312/DIG. 33

[56] References Cited

U.S. PATENT DOCUMENTS

| | | | |
|---|---|---|---|
| 2,532,636 | 12/1950 | Minnich | 206/377 |
| 2,710,093 | 6/1955 | Raker | 312/DIG. 33 |
| 3,182,856 | 5/1965 | Goltz | 206/509 |
| 3,330,608 | 7/1967 | Druger, Jr. | 206/509 |
| 3,836,008 | 9/1974 | Mraz | 211/74 |
| 3,949,747 | 4/1976 | Hevesy | 206/375 |
| 4,411,868 | 10/1983 | Noack | 211/74 |
| 4,643,494 | 2/1987 | Marleau | 312/DIG. 33 |
| 4,782,619 | 11/1988 | Richards | 312/DIG. 33 |
| 4,895,256 | 1/1990 | Johnston | 206/509 |

FOREIGN PATENT DOCUMENTS

| | | | |
|---|---|---|---|
| 2185195 | 7/1987 | United Kingdom | 211/74 |

*Primary Examiner*—Jimmy G. Foster
*Attorney, Agent, or Firm*—Varndell Legal Group

[57] ABSTRACT

A multi-storied tool box capable of neatly storing therein a great number of tools and having a first tool box and a second tool box is provided. The first tool box generally is of a rectangular crosssection to define a plurality of side surfaces on which separate grooves of different shapes and/or sizes are provided for respectively receiving therein different tools and has four top corner protrusions and four corresponding bottom corner indentations. The second tool box includes an upper piece having four top corner protrusions and a plurality of side surfaces provided with separate grooves, and two lower pieces defining therebetween a space capable of selectively receiving therein the first tool box and the upper piece of a lower second box.

18 Claims, 5 Drawing Sheets

MULTI-STORIED TOOL BOX

BACKGROUND OF THE INVENTION

The present invention relates to a tool box, and more particularly to a multi-storied one.

Numerous tools of different kinds and/or shapes and/or sizes are often required in a factory or a family and are always horizontally stored or vertically stored in the same plane of a tool box which is thus space-occupying and is inconvenient in storage and/or carriage. In addition, the tool is frequently freely placed in a storing groove therefore in the prior tool box, so that the tools become mixed-up together in the tool box therefore.

SUMMARY OF THE INVENTION

It is therefore an object of the present invention to provide a tool box capable of storing therein a great number of tools.

It is further an object of the present invention to provide a tool box capable of compactly and neatly storing therein tools.

According to the present invention, a multi-storied tool box includes a first tool box having side surfaces provided with storing retaining grooves, four top corner protrusions and four corresponding bottom corner indentations, and a second tool box including an upper piece having four top corner protrusions and groove-provided side surfaces and two lower pieces respectively having groove-provided side surfaces and defining therebetween a space capable of selectively receiving therein the first tool box and the upper piece of a lower second tool box.

The present invention may best be understood through the following description with reference to the accompanying drawings, in which:

DETAILED DESCRIPTION OF THE PREFERRED EMBODIMENT

Figure 1:
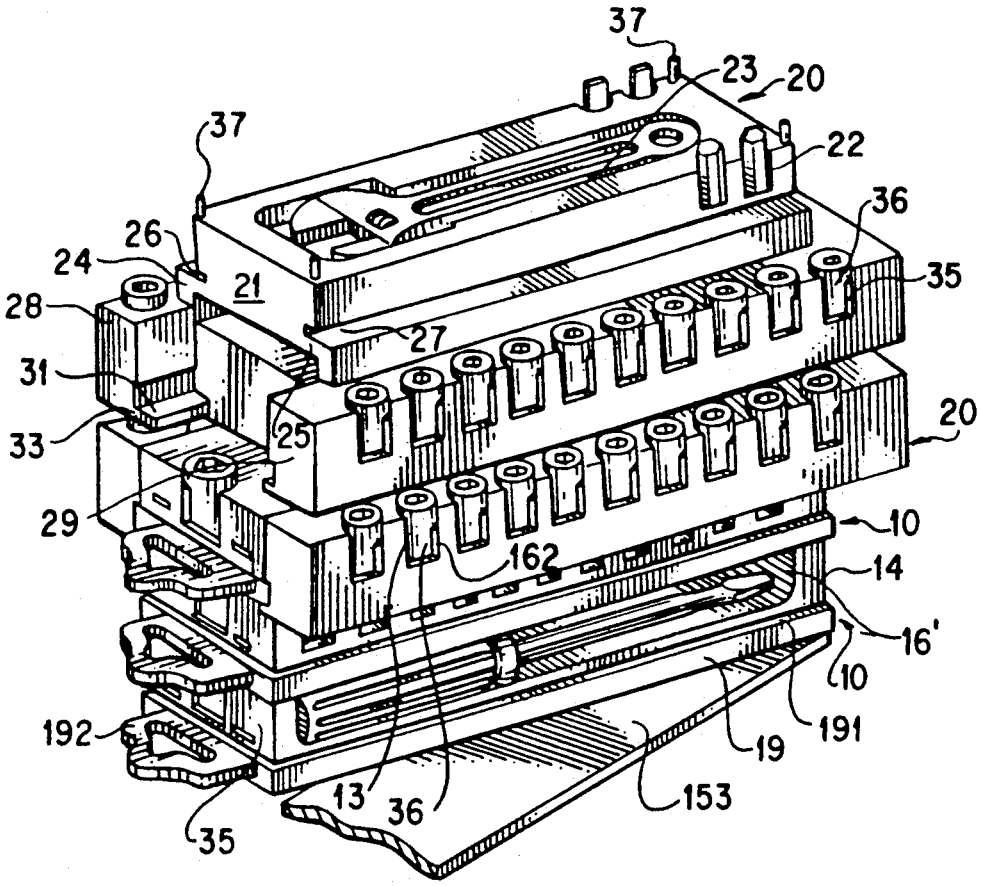
FIG. 1 is a perspective view showing a preferred embodiment of a multi-storied tool box according to the present invention.
Figure 1A:
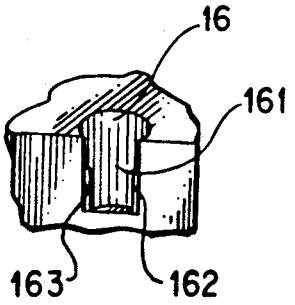
FIG. 1A is a detailed view showing a storing groove provided with opposite protuberances according to a tool box in FIG. 1.
Figure 2:
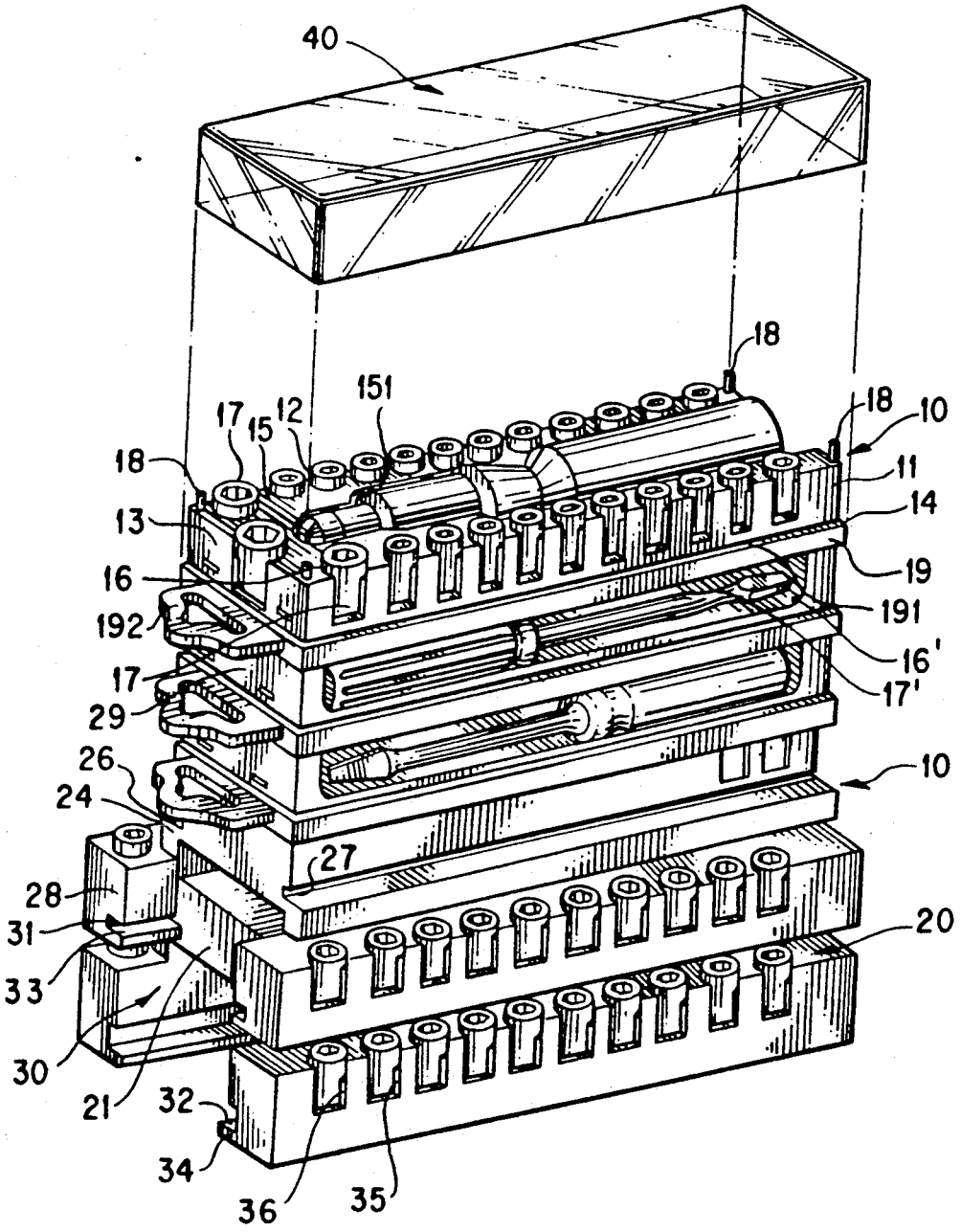
FIG. 2 is a perspective view showing further a preferred embodiment of a multi-storied tool box according to the present invention.
Figure 3:
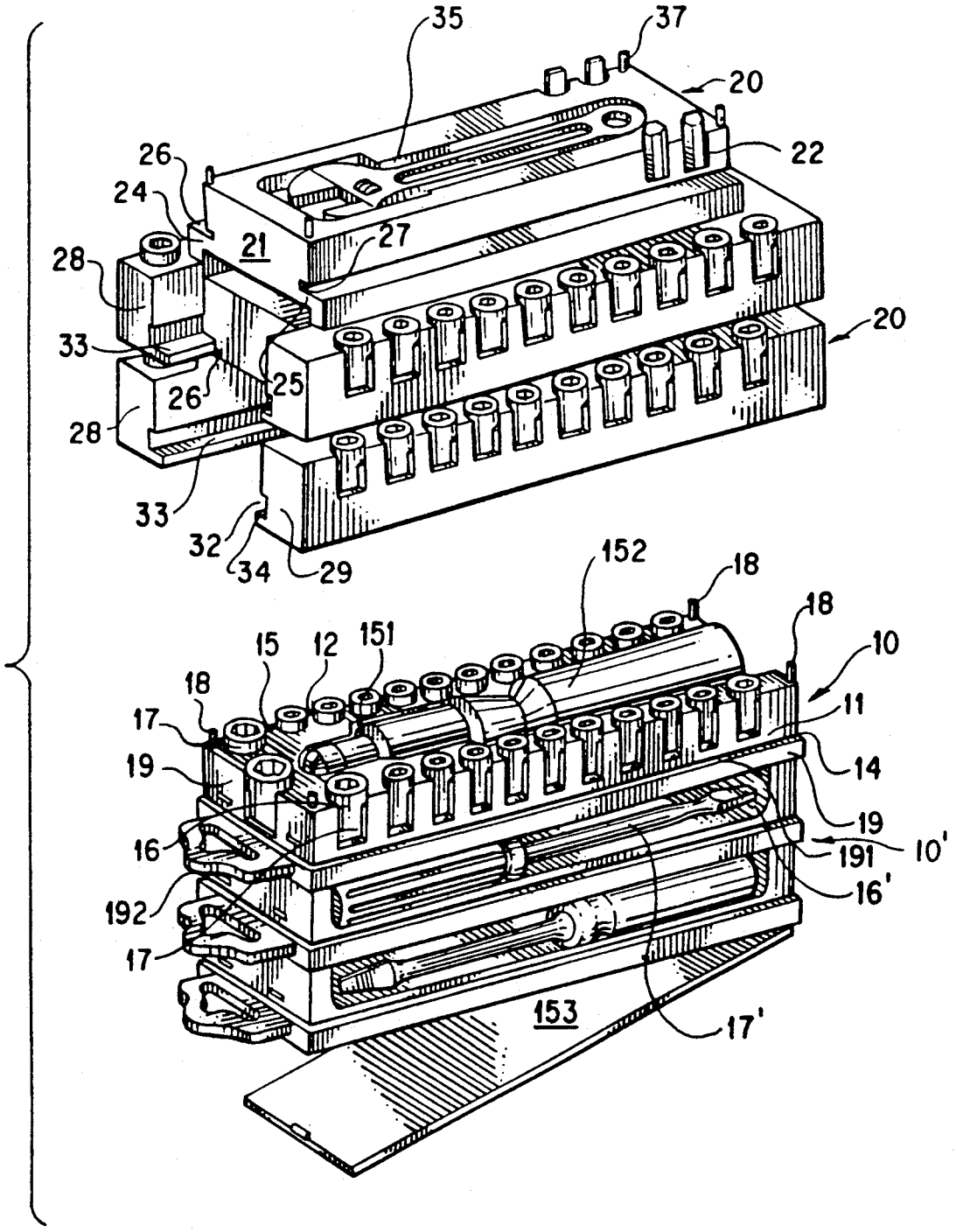
FIG. 3 is a perspective view showing a first tool boxes separated from second tool boxes of a multi-storied tool box in FIG. 1.
Figure 4:
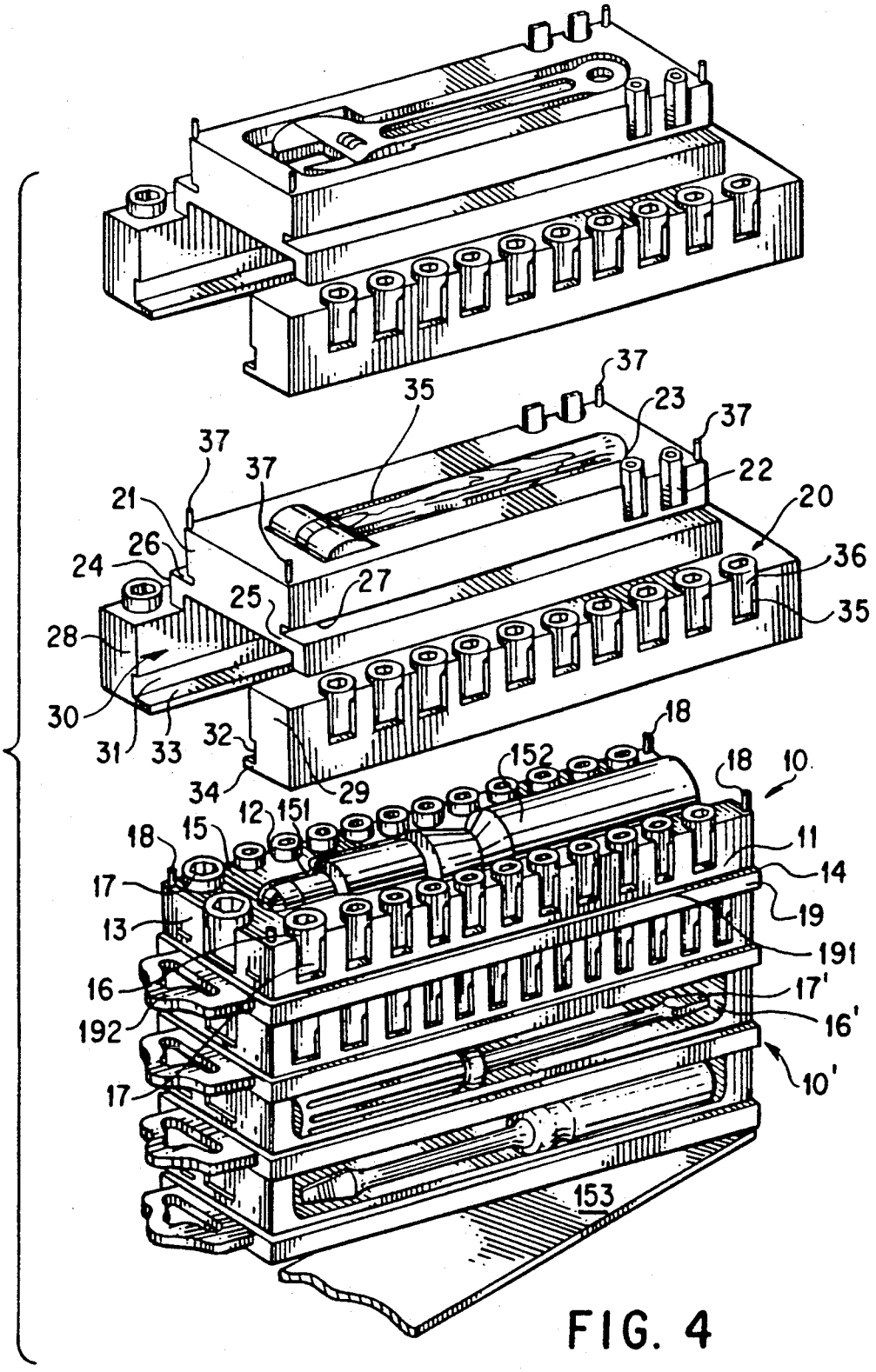
FIG. 4 is a perspective view showing separate second tool boxes and first tool boxes of a multi-storied tool box according to the present invention.
Figure 5:
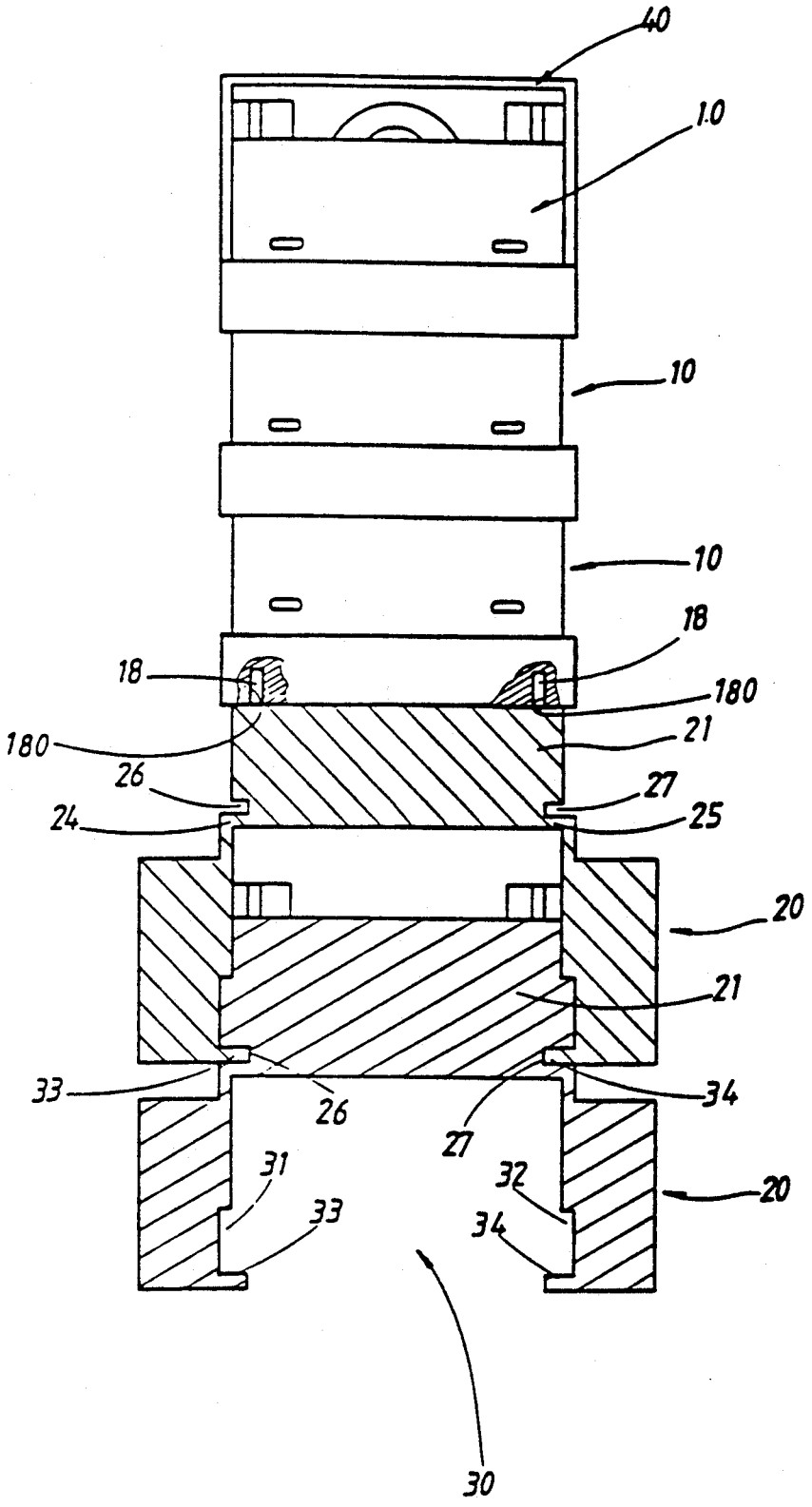
FIG. 5 is a schematically sectional view showing a multi-storied tool box in FIG. 2.

Referring now to FIGS. 1–5, a multi-storied tool box according to the present invention includes a plurality of first tool boxes 10 and a plurality of second tool boxes 20. Each tool box 10 generally is of a rectangular cross section to define a plurality of side surfaces 11, 12, 13, 14, 15 on which separate grooves of different shapes and/or sizes are provided for respectively receiving therein different tools. The grooves 16 on side surfaces 11, 12, 13 are parallelly spaced and are respectively open thereon in the manner that the defining wall 161 of each groove 16 includes on the respective open side surface 11, 12 or 13 two opposite protuberances 162, 163 upwardly extending from the bottom of groove 16 about 3/5 of the height of the respective groove 16 thus capable of better retaining therein a tool 17 which partly protrudes beyond the respective open side surface 11, 12 or 13 and is slightly higher than the height of the respective groove 16. Alternatively, side surface 11 or 12 can be provided with long groove 16' for receiving therein a long tool 17'. Each tool box 10 further includes four top corner protrusions 18, four corresponding bottom corner indentations 180 respectively capable of receiving therein corner protrusions 18 of a lower tool box 10, and a bottom skirt 19 which defines a peripheral ledge 191, attaches thereto a hanging piece 192 enabling tool box 10 to be hung and is capable of enclosing therein the upper portion of the lower tool box 10. Top surface 15 or the bottom surface can be provided with a long groove 151 for storing therein a long tool 152. A protecting plate 153 can be pivotally mounted to a bottom end of the lowest tool box 10 to be covered against skirt 19 to enable the lowest box 10 to have an entirely flat bottom surface.

Each tool box 20 includes an upper piece 21 provided on side surfaces thereof with grooves 22, 23 and having two bottom side extensions 24, 25 respectively provided with two outer longitudinal side grooves 26, 27, and two lower pieces 28, 29 which are respectively fixed to side extensions 24, 25, define therebetween a space 30, and respectively include two longitudinal inner channels 31, 32 respectively capable of slidably engaging therein two sides of bottom skirt 19 when first box 10 is received in space, two inwardly extending longitudinal rails 33, 34 respectively capable of engaging in longitudinal grooves 26, 27 of upper piece 21 of a lower second box 20, and on side surfaces thereof grooves 35 for respectively receiving therein tools 36.

When first box 10 is to be received under second box 20, two sides of skirt 19 of first box 10 are respectively slid into inner channels 31, 32 of second box 20 until first box 10 is received in space 30. Upper piece 21 of second box 20 is provided with four top corner protrusions 37 respectively capable of corresponding to four bottom corner indentations 180 of first box 10 so that when first box 10 is placed on second box 20, protrusions 37 can respectively be engaged in indentations 180. A transparent cover 40 can be provided for covering on first box 10.

Through the above description, it should now become readily apparent how and why the present invention can achieve the objects it contemplates. The above described embodiments are only illustrative and can easily be modified by those skilled in the art without departing from the scope of the present invention which is defined in the appended claims.

I claim:

1. A first tool box having a generally rectangular cross section and defining a plurality of side surfaces on which separate grooves of different shapes and/or sizes are provided for respectively receiving different tools therein, said first tool box having four top corner protrusions and four corresponding bottom corner indentations for receiving corner protrusions of another tool box which is identical to said first tool box in structure and disposed right beneath said first tool box, said first tool box further comprising a bottom skirt for enclosing therein an upper portion of said another tool box.

2. A tool box according to claim 1 wherein said grooves are parallelly spaced and are respectively open on said side surfaces on which said grooves are respectively provided, and defining wall of each of said grooves includes on said respective open side surface two opposite protuberances by which one of said tools is better retained in said each groove.

3. A tool box according to claim 1 wherein said grooves include a relatively long groove capable of receiving therein a relatively long tool.

4. A tool box according to claim 1, further comprising a transparent cover for covering said first tool box.

5. A tool box according to claim 1, further comprising a hanging piece enabling said first tool box to be hung.

6. A tool box according to claim 1, further comprising a protecting plate pivotally mounted to a bottom end of said first tool box.

7. A first multi-storied tool box comprising:

an upper piece having two bottom side extensions and a plurality of side surfaces on which separate grooves of different shapes and/or sizes are provided for respectively receiving therein different tools; and two lower pieces respectively fixed to said side extensions, respectively having on at least one side surfaces thereof a plurality of separate grooves, and defining therebetween a space capable of receiving therein said upper piece of another multi-storied tool box which is identical to said first box in structure and disposed right beneath said first box.

8. A multi-storied tool box according to claim 7 wherein: said upper piece includes two longitudinal side grooves; and said lower pieces respectively include two longitudinal and inwardly extending rails capable of respectively engaging in said longitudinal grooves of said upper piece of said another multi-storied tool box.

9. A multi-storied tool box according to claim 7 wherein said grooves are parallelly spaced and are respectively open on said side surfaces on which said grooves are respectively provided, and a defining wall of each of said grooves includes on said respective open side surface two opposite protuberances by which one of said tools is better retained in said each groove.

10. A multi-storied tool box according to claim 7 wherein said separate grooves include a relatively long groove capable of receiving therein a relatively long tool.

11. A multi-storied tool box according to claim 7, further comprising a transparent cover for covering said first tool box.

12. A multi-storied tool box comprising:

a first tool box generally being of a rectangular crossection to define a plurality of side surfaces on which separate grooves of different shapes and/or sizes are provided for respectively receiving therein different tools, and having four top corner protrusions and four corresponding bottom corner indentations; and a basic second tool box including an upper piece having four top corner protrusions, two bottom side extensions and a plurality of side surfaces on which separate grooves of different shapes and/or sizes are provided for respectively receiving therein different tools, and two lower pieces which are respectively fixed to said side extensions, respectively have on at least one side surfaces thereof a plurality of separate grooves, and define therebetween a space capable of selectively receiving therein said first tool box and said upper piece of another second tool box which is identical to said basic box in structure and disposed right beneath said basic second box.

13. A multi-storied tool box according to claim 12 wherein:

said first box includes a bottom peripheral skirt; said upper piece includes two longitudinal side grooves; and said lower pieces respectively includes two longitudinal and inwardly extending rails capable of respectively engaging in said longitudinal grooves of said upper piece of said another second box, and two inner longitudinal channels respectively capable of slidably engaging therein two sides of said bottom skirt when said first box is received in said space.

14. A multi-storied tool box according to claim 12 wherein said grooves are parallelly spaced and are respectively open on said side surfaces on which said grooves are respectively provided, and a defining wall of each of said grooves includes on said respective open side surface two opposite protuberances by which one of said tools is better retained in said each groove.

15. A multi-storied tool box according to claim 12 wherein said separate grooves include a relatively long groove capable of receiving therein a relatively long tool.

16. A multi-storied tool box according to claim 12, further comprising a transparent cover for covering an upper one of said first and second tool boxes.

17. A multi-storied tool box according to claim 12, further comprising a hanging piece enabling said first tool box to be hung.

18. A multi-storied tool box according to claim 12, further comprising a protecting plate pivotally mounted to a bottom end of said first tool box.

* * * * *